United States Patent [19]

Feldman

[11] Patent Number: 4,495,985

[45] Date of Patent: Jan. 29, 1985

[54] DISASSOCIATIVE/REASSOCIATIVE CHEMICAL HEAT PUMP

[76] Inventor: Stephen Feldman, 110 Lombard St., Philadelphia, Pa. 19147

[21] Appl. No.: 520,936

[22] Filed: Aug. 8, 1983

[51] Int. Cl.[3] ..... F28D 21/00; F28D 15/00

[52] U.S. Cl. ..... 165/1; 126/433; 126/900; 165/104.12

[58] Field of Search ..... 165/104.12, 1; 126/900, 126/433

[56] References Cited

U.S. PATENT DOCUMENTS

| | | | |
|---|---|---|---|
| 3,075,361 | 1/1963 | Lindberg, Jr. | 62/4 |
| 3,370,420 | 2/1968 | Johnson | 60/36 |
| 3,943,719 | 3/1976 | Terry et al. | 60/644 |
| 4,158,354 | 6/1979 | Carden | 126/900 |
| 4,346,752 | 8/1982 | Kesten et al. | 165/1 |
| 4,365,661 | 12/1982 | Tripoli | 165/104.12 |
| 4,424,805 | 1/1984 | Neary | 126/417 |
| 4,449,516 | 5/1984 | Kitao et al. | 126/900 |

FOREIGN PATENT DOCUMENTS

| | | | |
|---|---|---|---|
| 2712411 | 10/1978 | Fed. Rep. of Germany | 126/900 |
| 2725326 | 12/1978 | Fed. Rep. of Germany | 126/900 |
| 2810360 | 10/1979 | Fed. Rep. of Germany | 126/900 |
| 64833 | 6/1978 | Japan | 126/900 |

*Primary Examiner*—Albert W. Davis, Jr.
*Attorney, Agent, or Firm*—Seidel, Gonda & Goldhammer

[57] ABSTRACT

A heat pump system includes a chemical which is disassociated into lower molecular weight species in the liquid state upon exposure to radiation such as ultraviolet light. The disassociated species then spontaneously change to the gaseous phase with a simultaneous absorption of heat. Heat is removed from either the disassociated gaseous species or the reassociated gaseous species to a heat sink thereby causing their return to the liquid phase.

20 Claims, 4 Drawing Figures

DISASSOCIATIVE/REASSOCIATIVE CHEMICAL HEAT PUMP

BACKGROUND OF THE INVENTION

1. Field of the Invention

This invention relates generally to heat pumps and more particularly concerns transfering heat energy between two different temperatures by means of the cyclical disassociation and reassociation of chemical species. The traditional need for a compressor is eliminated, resulting in significant cost reduction in both capital and operating expenses.

2. Prior Art

Conventional rankine cycle heat pumps use a compressor to change the phase of a secondary fluid, such as Freon. The compressor represents the major energy consuming portion of a heat pump system. Chemical heat pumps use phase changing chemicals. Both systems are rather inefficient compared to the present invention.

OBJECT OF THE INVENTION

The principal object of the present invention is to provide the transfer of heat via a closed loop system without the need for a compressor.

A further object is to provide a heat pump system which enables the elimination of moving parts.

A still further object is to provide a heat pump with substantially lowered operating costs due to the greatly decreased consumption of electrical power.

A still further object is to provide a heat pump which requires a smaller working area than that required by those utilizing compressor systems.

A still further object is to provide a heat pump which eliminates the traditional maintenance necessary with present heat pumps of compressor design.

SUMMARY OF THE INVENTION

In accordance with the invention, the primary fluid of the heat pump system is a chemical (or combination of chemicals) which is capable of being cyclically disassociated and reassociated by radiative or electrical means, as exemplified by the class of chemicals referred to as polymers, some of which are capable of being depolymerized by radiation and spontaneously repolymerized when removed from the radiation environment.

In one form of the invention ultraviolet light causes the disassociation of a chemical into a species which spontaneously changes from liquid to a gaseous state, through the absorption of heat from its surroundings. Upon the spontaneous reassociation of the gaseous species, heat is evolved.

The original chemical species returns to the liquid state simultaneously with the removal of the heat evolved to a heat sink. This may be summarized by the following equations where the boiling point of A is less than the boiling point of $A_2$.

$$A_2(\text{liquid}) \xrightarrow[\text{light}]{\text{ultraviolet}} A(\text{liquid}) + A(\text{liquid})$$

Spontaneously:

$$A(\text{liquid}) + A(\text{liquid}) \xrightarrow[\text{heat absorbed}]{Q_v} A(\text{gaseous}) + A(\text{gaseous})$$

-continued $$A(\text{gaseous}) + A(\text{gaseous}) \longrightarrow A_2(\text{gaseous})$$

$$A_2(\text{gaseous}) \longrightarrow A_2(\text{liquid}) + \text{heat}$$

The pressure of the high pressure liquid may be reduced by an expansion valve or device. The reassociated liquid is then returned to the ultraviolet light source for disassociation.

DETAILED DESCRIPTION OF THE INVENTION

The first law of thermodynamics states a relationship between E(Internal Energy), O(Heat) and W(Work). If one considers work of expansion only, $$W = \int_{V/1}^{V/2} PdV$$

thus in a constant volume process the work integral equals zero. That is, no net mechanical work is obtained.

In most situations of interest, if a chemical reaction is carried out at constant volume, no work of any kind is obtained and $$\Delta E_v = O_v$$

thus, at constant volume, the heat quantity accompanying the process depends only on the initial and final states. In other words, the internal energy, E, is a thermodynamic property and if a process is used in which only PdV work is done, and the volume is held constant, the heat absorbed or evolved is independent of the path and depends only on the nature and state of the initial and final reactants. Thus, one is afforded the opportunity of minimizing the amount of energy necessary to achieve this change, although the amount of energy transferred (in this case as heat) is constant. Thus, one can choose a set of "different paths" in going from state A to state B. At present the conventional heat pump utilizes a gas which is compressed mechanically to a liquid form and then allowed to expand to its original gaseous state, absorbing heat from its surroundings in the process.

Figure 1:
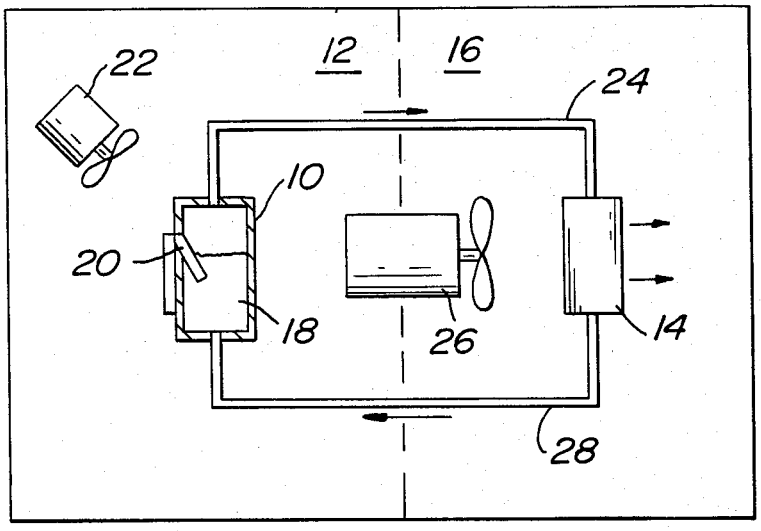
FIG. 1 is a diagrammatic representation of the heat pump system of the present invention in a cooling mode.

A basic heat pump system of the present invention is shown in FIG. 1 in the cooling mode. The disassociation unit 10 is located within a space 12 which is to be cooled and the heat exchange unit or condenser 14 is located in a space 16 outside of the space to be cooled. Typically, the space 12 is the inside of a building and the space 16 is outside adjacent to the building.

The system includes a liquid chemical species 18 such as a polymer which disassociates or depolymerizes upon exposure to radiation, such as ultraviolet light, forming a gas and reassociates or repolymerizes upon being condensed. Examples of chemicals which will disassociate on exposure to radiation and reassociate include conjugated carbonyl compounds such as aromatic keytones, dicarbonyls, enones, and quinones. Carbonyl compounds on excitation produce triplet excited species in high yields through intersystem crossing. This excitation energy is subsequently lost by non-radiative decay, with minor contributions of fluorescence and phosphorescense. For example quinones 1,2 dicarbonyl compounds are typical. Other excellent examples are photodimerizations, cyclo-hexadienones and related compounds.

The chemical 18 is exposed to radiation from radiation source 20 within the disassociation unit 10. Upon exposure to the radiation, the chemical disassociates into lower molecular weight species. These disassociated products will be referred to collectively as "disassociated chemical".

The disassociated chemical changes from liquid to gaseous phase within the disassociation unit 10 absorbing heat and forming a high pressure gas. To improve the cooling efficiency of the disassociation unit, a fan 22 directs the indoor air across the disassociation unit.

The high pressure gaseous disassociated chemical is directed by conduit 24 to condenser 14 where it is condensed and reassociated. The reassociation is accellerated within the condenser because the number of physical interactions between the molecules is increased due to the increased density. The reassociation reactions give off heat which is transferred to the outdoor air. The fan 26 directs the outdoor air across the condenser to improve the heat transfer. The condensed and reassociated chemical is returned to the disassociation unit by conduit 28.

Because of the difference of density between the high pressure gaseous disassociated chemical and the high pressure liquid reassociated chemical, and because of the condensation of the gaseous chemical, the disassociated and reassociated chemical heat exchange fluid will circulate through the system without a pump. If the condenser 14 is located at an elevation higher than the disassociation unit 10, the condensing chemical liquid will flow toward the disassociation unit to replace the liquid evaporated in the disassociation unit and maintain the liquid levels in the condenser or conduit and the disassociation unit equal. Also the reassociation and condensing of the gaseous disassociated chemical will create a region of lower pressure which will cause the gaseous disassociated chemical to flow toward the condenser. Therefore, the system will operate without any moving mechanical devices or the associated energy losses. However, a pump may be included in one of the conduits to assist flow of the fluid.

Figure 2:
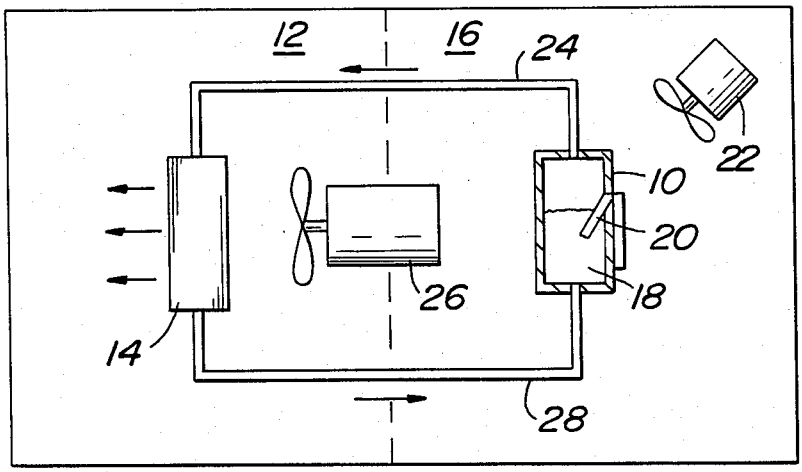
FIG. 2 is a diagrammatic representation of the heat pump system in a heating mode.

In the cooling mode shown in FIG. 1, the indoor air within the building space 12 is the source of heat which is pumped to the outdoor air in space 16 which acts as the heat sink. As shown in FIG. 2, to operate in heating mode the location of the components are interchanged. The disassociation unit 10 and fan 22 are located in the outdoor space 16 and fan 26 directs indoor air across the heat exchange unit 14 located in the indoor space 12. Therefore, heat is transferred from the outdoor air to the indoor air to warm the building.

Figure 3:
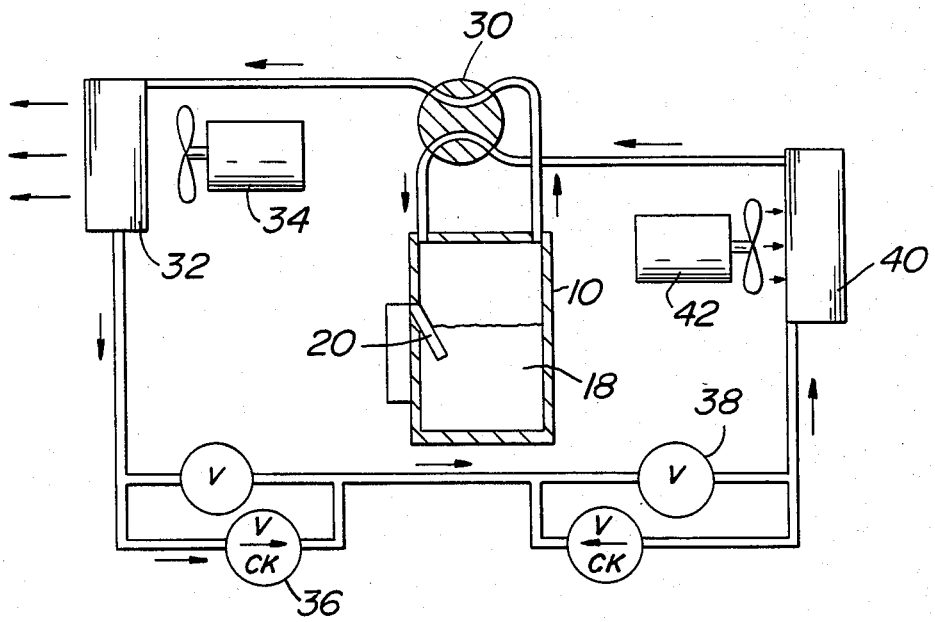
FIG. 3 is a diagrammatic representation of the heat pump system of the present invention is adapted to a conventional heat pump system in the cooling mode.
Figure 4:
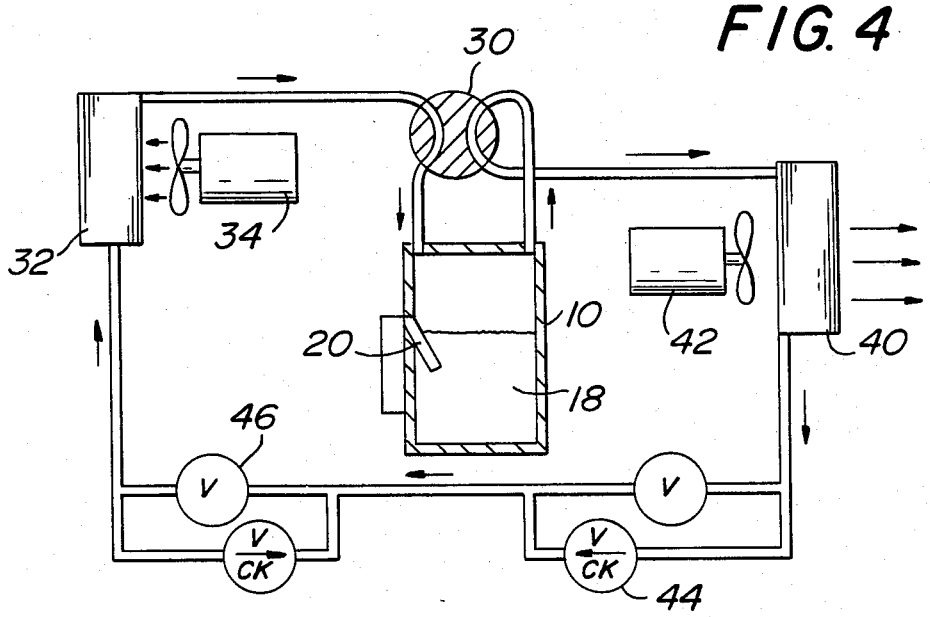
FIG. 4 is a diagrammatic representation of the heat pump system as adapted to a conventional heat pump system in the heating mode.

As shown in FIGS. 3 and 4, the system may be retrofitted into an existing conventional heat pump system. FIG. 3 shows the system operating in the cooling mode. The high pressure gaseous disassociated chemical formed in the disassociation unit 10 flows through the four way valve 30 to an outdoor heat exchanger or condenser 32.

Heat is transferred from the high pressure gaseous disassociated chemical within the heat exchanger 32 to the outdoor air which is directed by fan 34 over the heat exchanger 32. Upon condensing, the disassociated chemical reassociates giving off additional heat.

The high pressure reassociated liquid chemical flows through check valve 36 and expansion valve 38. The low pressure liquid from the expansion valve is directed to the indoor heat exchanger or evaporator 40 where heat is transferred from the indoor air which is directed by fan 42 across the heat exchanger 40 to the reassociated chemical. The reassociated chemical vaporizes within the heat exchanger 40 to form a low pressure vapor which flows through the four way valve 30 back to the disassociation unit 10.

To operate the system in the heating mode, the four way valve 30 is repositioned as shown in FIG. 4 so that the high pressure gaseous disassociated chemical is directed from the disassociation unit 10 through the four way valve 30 to the indoor heat exchanger 40. Heat is transferred from the disassociated chemical within the indoor heat exchanger to the indoor air, condensing and reassociating the chemical.

The high pressurre reassociated liquid chemical is directed through check valve 44 to expansion valve 46. The low pressure liquid from the expansion valve is directed to the outdoor heat exchanger 32 where the reassociated chemical is vaporized. The low pressure vapor chemical is then redirected to the disassociation unit 10 through the four way valve 30 to the indoor heat exchanger 40. Heat is transferred from the disassociated chemical within the indoor heat exchanger to the indoor air, condensing and reassociating the chemical.

The high pressure reassociated liquid chemical is directed through check valve 44 to expansion valve 46. The low pressure liquid from the expansion valve is directed to the outdoor heat exchanger 32 where the reassociated chemical is vaporized. The low pressure vapor chemical is then redirected to the disassociation unit 10 by four way valve 30.

Laboratory tests have been conducted using an ultraviolet laser to prove that the system can be used as a heat pump. Conjugated carbonyl compounds such as aromatic keytones, dicarbonyls, enones and quinones are disassociated by the ultraviolet laser to form a gaseous disassociated chemical. Upon cooling of the disassociated chemical, it condenses and reassociates to form the original chemical.

As in the conventional heat pump system, the change of phase between liquid and gas is accompanied by the absorption and release of the latent heat of vaporization. The rate of disassociation within the disassociation unit can be varied by changing the intensity or wave length of the radiation emitted by the radiation source. Since the flowrate of fluid is influenced by the rate of disassociation, the flowrate of fluid can be varied by controlling the rate of disassociation.

The present invention may be embodied in other specific forms without departing from the spirit or essential attributes thereof and, accordingly, reference should be made to the appended claims, rather than to the foregoing specification, as indicating the scope of the invention.

I claim:

1. A heat pump system comprising a chemical, means for disassociating the chemical and spontaneously, completely changing the phase of the chemical upon disassociating, means for reassociating the disassociated chemical, and first and second conduit means between said disassociating means and said reassociating means for carrying said disassociated chemical to said reassociating means and for carrying said reassociated chemical to said disassociating means, respectively.

2. A heat pump system according to claim 1, wherein the reassociating means includes a heat exchanger to remove heat from the disassociated chemical.

3. A heat pump system in accordance with claim 1, wherein the disassociating means includes a source of radiation.

4. A heat pump system in accordance with claim 3, wherein the radiation source is a source of ultraviolet radiation.

5. A heat pump system in accordance with claim 3, wherein the disassociating means includes means for varying the rate of disassociation.

6. A heat pump system in accordance with claim 5, wherein the means for varying the rate of disassociation includes means for varying the intensity of the radiation emitted by the radiation source.

7. A heat pump system in accordance with claim 5, wherein the means for varying the rate of disassociation includes means for varying the wave length of the radiation emitted by the radiation source.

8. A heat pump system in accordance with claim 1, wherein the chemical is selected from the group consisting of aromatic keytones, dicarbonyls, enones and quinones.

9. A heat pump system in accordance with claim 1, wherein the chemical is a polymer, the disassociating means is a depolymerizing means, and the reassociating means is a repolymerizing means.

10. A heat pump system in accordance with claim 1, wherein the system includes a pump for circulating the chemical within the system.

11. A heat exchange system in accordance with claim 5, including means for sensing the extent of disassociation of the disassociated chemical for controlling the rate of disassociation.

12. A heat pump system in accordance with claim 1, wherein the disassociating means includes a laser having a wave length which promotes disassociation of the chemical.

13. A heat pump system in accordance with claim 1, wherein the disassociating means includes an electrical source.

14. A heat pump system comprising a chemical selected from the group consisting of aromatic keytones, dicarbonyls, enones and quinones, means for disassociating the chemical and spontaneously, completely changing the phase of the chemical upon disassociating including a radiation source, means for reassociating the disassociated chemical including a heat exchanger, and first and second conduit means between said disassociating means and said reassociating means for carrying said disassociated chemical to said reassociating means and for carrying said reassociated chemical to said disassociating means, respectively.

15. A heat pump system in accordance with claim 14, wherein the disassociating means includes means to vary the rate of disassociation.

16. A method for transferring heat energy between two different temperatures comprising disassociating a chemical with a spontaneous and complete change of phase, transferring heat from the disassociated chemical to a heat sink, reassociating the disassociating chemical and transferring heat to the reassociated chemical from a heat source.

17. A method in accordance with claim 16, wherein the heat is transferred to the reassociated chemical within the disassociating means.

18. A method in accordance with claim 16, in which the chemical is disassociated with ultraviolet radiation.

19. A method in accordance with claim 16, in which the chemical is selected from the group consisting of aromatic keytones, dicarbonyls, enones and quinones.

20. A method in accordance with claim 16, in which the chemical is a polymer which is depolymerized and repolymerized.

* * * * *